US009254044B2

(12) United States Patent
Dudik

(10) Patent No.: US 9,254,044 B2
(45) Date of Patent: Feb. 9, 2016

(54) FOLDABLE TABLE FOR CHAIR

(71) Applicant: Jill Dudik, Canfield, OH (US)

(72) Inventor: Jill Dudik, Canfield, OH (US)

( * ) Notice: Subject to any disclaimer, the term of this patent is extended or adjusted under 35 U.S.C. 154(b) by 0 days.

(21) Appl. No.: 14/640,289

(22) Filed: Mar. 6, 2015

(65) Prior Publication Data

US 2015/0173518 A1 Jun. 25, 2015

Related U.S. Application Data

(63) Continuation-in-part of application No. 14/132,210, filed on Dec. 18, 2013, now abandoned.

(60) Provisional application No. 61/818,018, filed on May 1, 2013.

(51) Int. Cl.
*A47C 7/70* (2006.01)
*A47C 4/28* (2006.01)

(52) U.S. Cl.
CPC .. *A47C 7/70* (2013.01); *A47C 4/283* (2013.01)

(58) Field of Classification Search
CPC ..... A47C 7/68; A47C 7/70
USPC ..... 297/145, 148, 155, 160–162, 173
See application file for complete search history.

(56) References Cited

U.S. PATENT DOCUMENTS

| | | | | | |
|---|---|---|---|---|---|
| 1,362,489 | A | * | 12/1920 | Karschitz | 297/130 |
| 2,566,113 | A | * | 8/1951 | Bayless | 297/161 |
| 3,547,488 | A | * | 12/1970 | Barnes | 297/162 |
| 3,894,496 | A | * | 7/1975 | Phillips et al. | 108/50.11 |
| 4,779,884 | A | * | 10/1988 | Minati | 280/304.1 |
| 4,852,940 | A | * | 8/1989 | Kanigowski | 297/145 |
| 4,878,685 | A | * | 11/1989 | Bahm | 297/162 |
| 5,228,711 | A | * | 7/1993 | Summers | 297/161 |
| 5,588,663 | A | * | 12/1996 | Rundle et al. | 280/304.1 |
| 5,918,550 | A | * | 7/1999 | Weir et al. | 297/135 |
| 2007/0216201 | A1 | * | 9/2007 | Hart | 297/162 |

* cited by examiner

*Primary Examiner* — Peter Brown
(74) *Attorney, Agent, or Firm* — Buckingham, Doolittle & Burroughs, LLC

(57) ABSTRACT

A removable tray device is disclosed that offers a simple and easy way to eat or drink when sitting outside. The removable tray device comprises a tray component secured to a folding chair via a pinned hinge that allows the tray component to rotate vertically and a swivel component that allows the tray component to swivel horizontally. The tray component further comprises a catch or lock bracket on a leg of the chair which corresponds with a mating lock pin secured to a back edge of the tray component. Specifically, the lock pin of the tray component mates to and is secured within the catch or lock bracket to further secure the tray component to the folding chair when the tray component is in front of the folding chair or is to the side of the folding chair.

17 Claims, 9 Drawing Sheets

FOLDABLE TABLE FOR CHAIR

CROSS-REFERENCE

This application is a continuation-in-part of Utility patent application Ser. No. 14/132,210 filed Dec. 18, 2013, which claims priority from Provisional Patent Application Serial No. 61/818,018 filed May 1, 2013.

BACKGROUND

It can be difficult for individuals to eat or drink when sitting outside or away from a table or other stable generally horizontal surface. People typically have to balance a full plate of food on their lap while clutching their drink in one hand and their eating utensils in the other hand. Further, with any sudden movement, individuals can bobble their plate or beverage and spill it all over their lap. This can be a messy, frustrating, embarrassing and extremely inconvenient experience. An effective solution is necessary.

The present invention provides a flat tray surface for eating, drinking, or other activities when sitting outside or when a table or other surface is not readily available to place one's plate or cup on, and rotates down against the side of the chair when not in use for convenient storage. The removable tray device prevents users from spilling food or beverages on their lap and making a mess, and eliminates the hassle of transporting and setting up an outdoor table and chairs, The tray device benefits everyone, including campers, sports fans, and anyone enjoying the outdoors.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a removable tray device that offers a simple and easy way to eat or drink when sitting outside or away from a traditional table. The removable tray device comprises a tray component secured to a folding chair via a pinned hinge that allows the tray component to rotate vertically (i.e., flip 180 degrees) and a swivel component that allows the tray component to swivel horizontally. The tray component further comprises a catch or lock bracket on a leg of the chair which corresponds with a mating lock pin secured to a back edge of the tray component. Specifically, the lock pin of the tray component mates to and is secured within the catch or lock bracket to further secure the tray component to the folding chair when the tray component is in front of the folding chair or is to the side of the folding chair.

In a preferred embodiment, the tray component comprises a cut-out drink holder on the top surface for retaining a beverage or other item. Additionally, the tray component further comprises a support leg that is secured to the side of the tray component. The support leg can be telescopically extended to rest on the floor for additional support when the tray component is in use.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DESCRIPTION OF PREFERRED EMBODIMENTS

Figure 1:
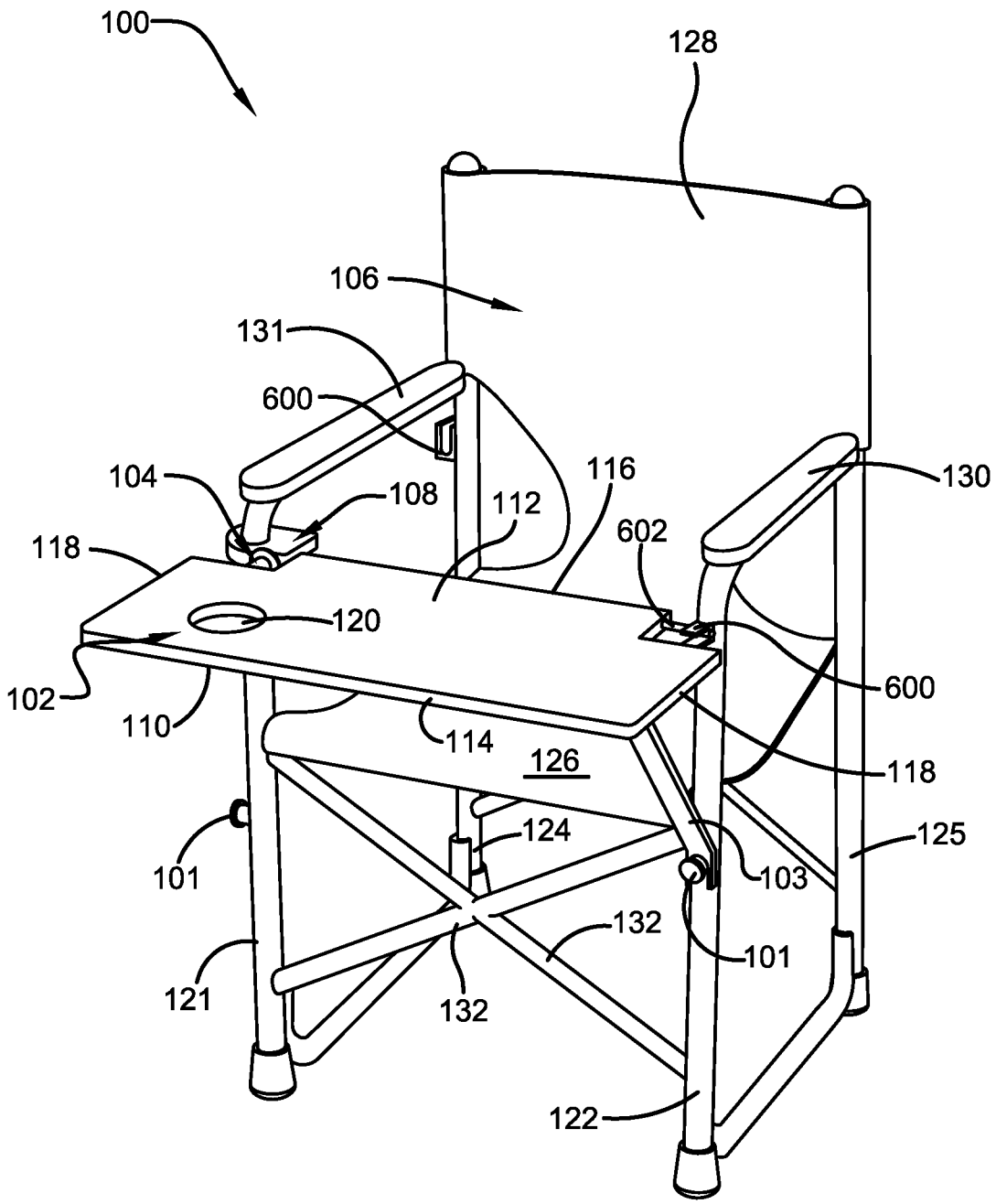
FIG. 1 illustrates a perspective view of the removable tray device extended in front of a chair in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

The present invention provides a flat tray surface for eating, drinking, or other activities when sitting outside or away from a traditional table, and rotates down against the side of the chair when not in use for convenient storage. The removable tray device prevents users from spilling food or beverages on their lap and making a mess, and eliminates the hassle of transporting and setting up an outdoor table and chairs. The tray device benefits everyone, including campers, sports fans, and anyone enjoying the outdoors or who does not have ready access to a traditional table.

The disclosed removable tray device comprises a tray component secured to a folding chair via a pinned hinge that allows the tray component to rotate vertically and a swivel component that allows the tray component to swivel horizontally. The tray component further comprises a catch or lock bracket on a leg of the chair which corresponds with a mating lock pin secured to a back edge of the tray component. Specifically, the lock pin of the tray component mates to and is secured within the catch or lock bracket to further secure the tray component to the folding chair when the tray component is in front of the folding chair or is to the side of the folding chair.

Figure 2:
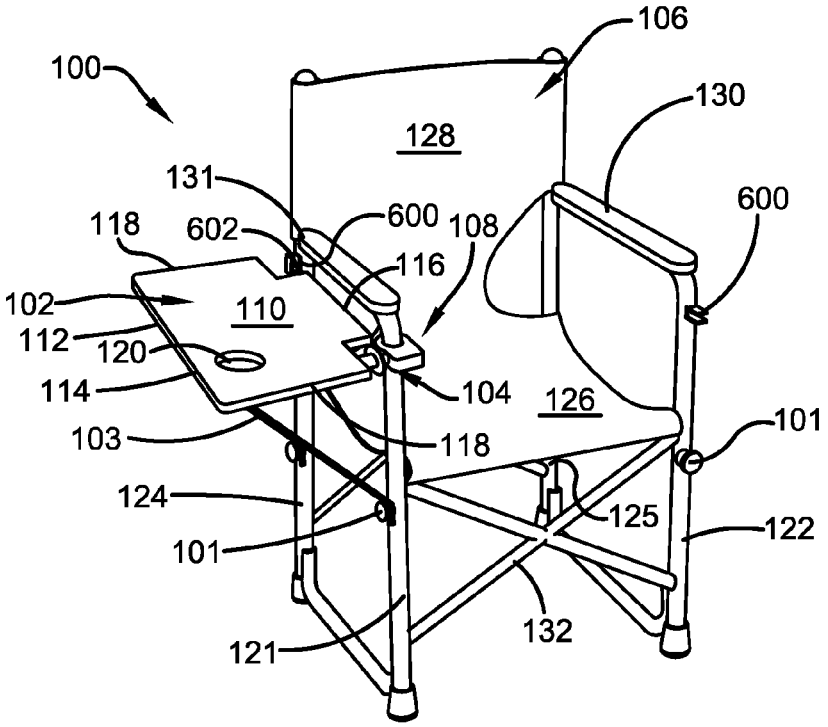
FIG. 2 illustrates a perspective view of the removable tray device extended at the side of a chair in accordance with the disclosed architecture.
Figure 3:
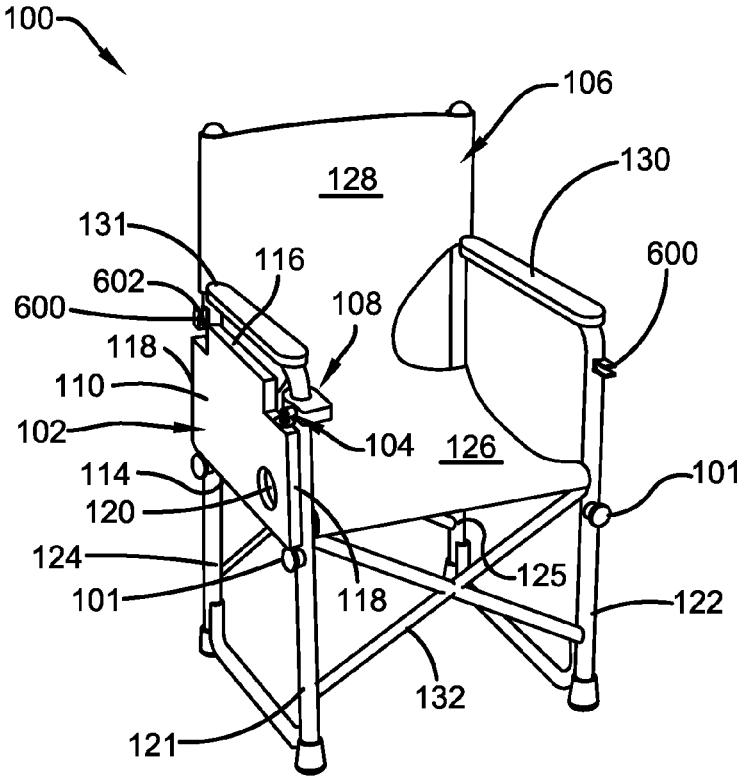
FIG. 3 illustrates a perspective view of the removable tray device rotated down in accordance with the disclosed architecture.
Figure 4A:
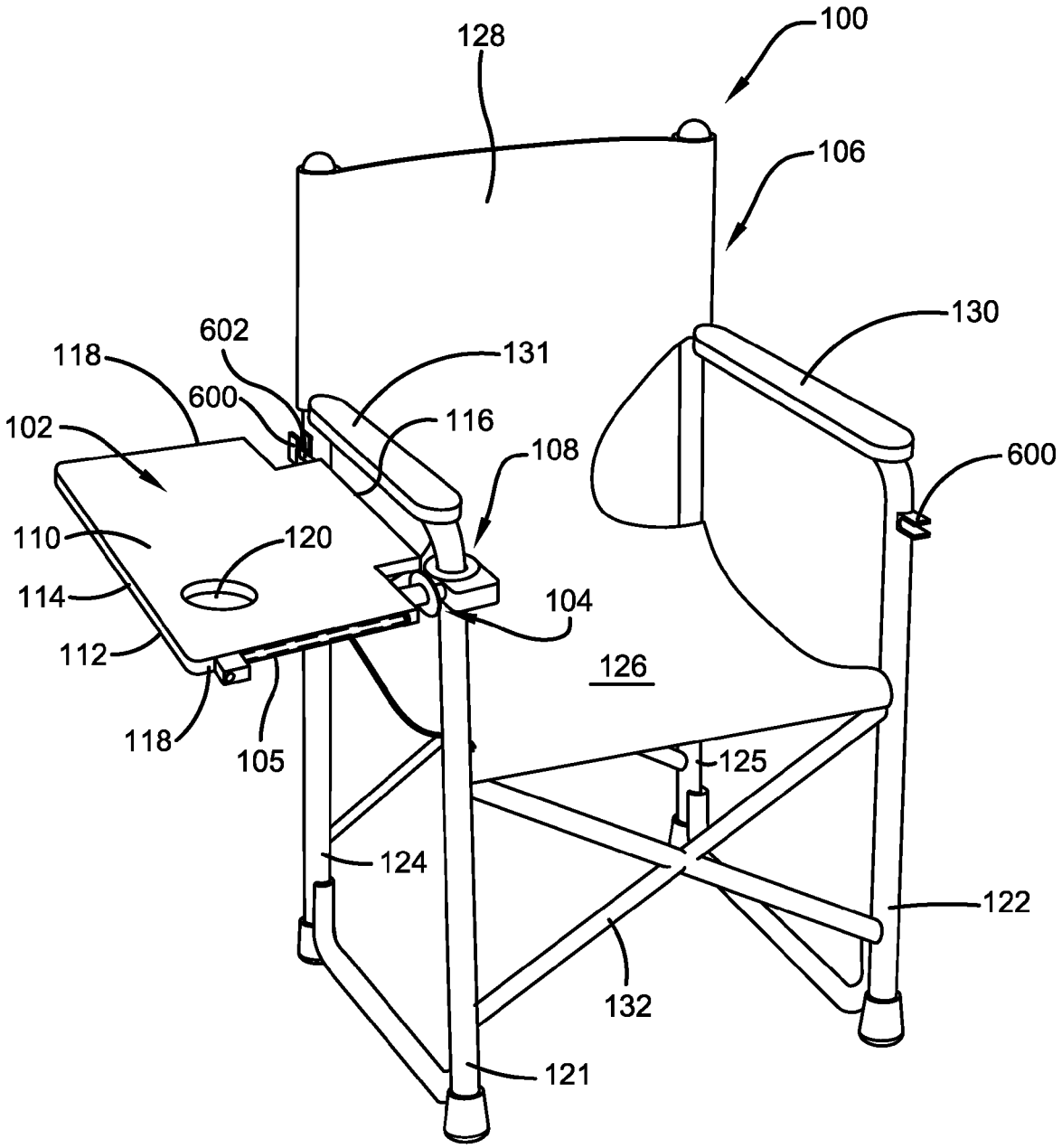
FIGS. 4A-4C illustrate a perspective view of the removable tray device rotating in accordance with the disclosed architecture.
Figure 4B:
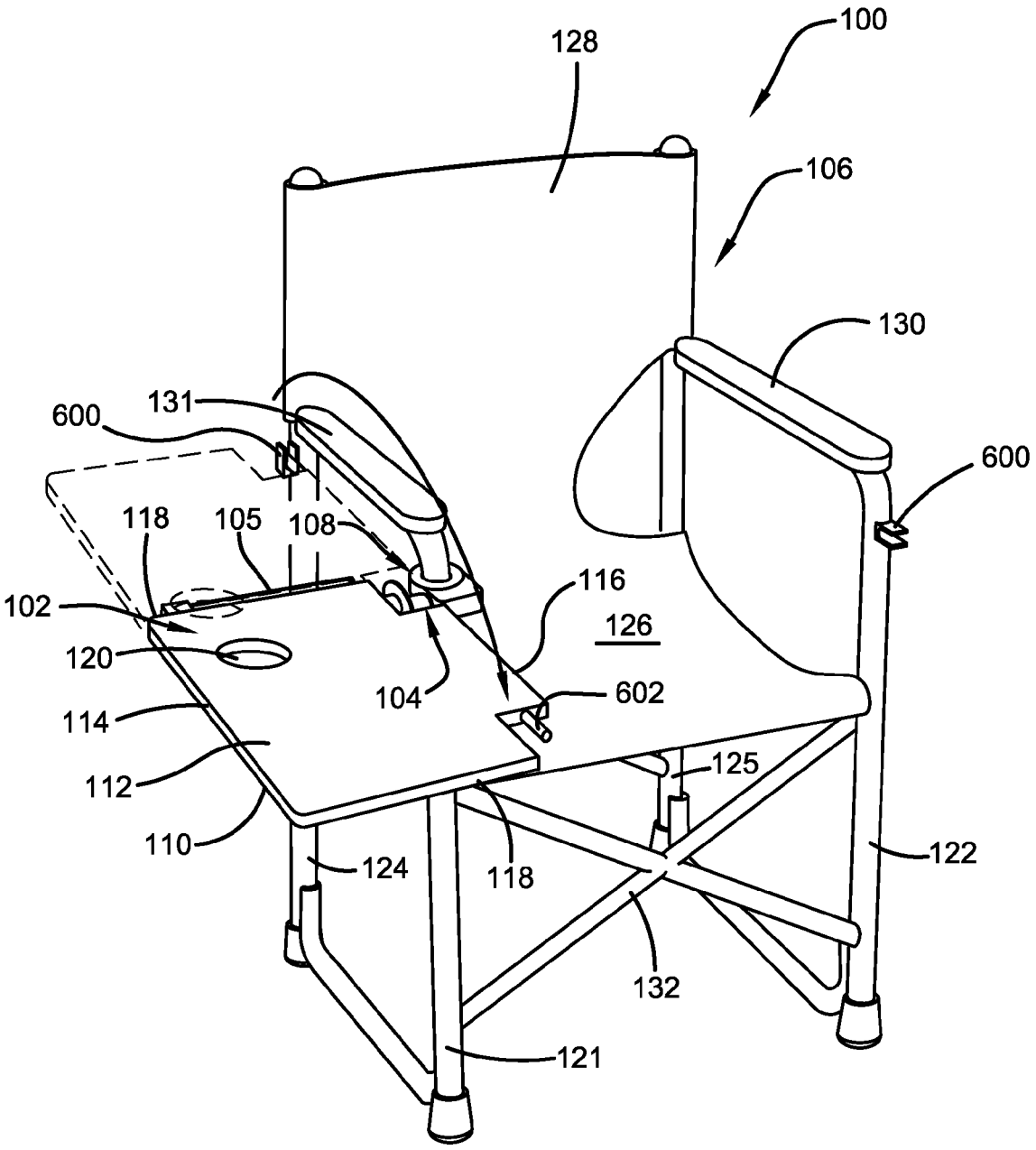
Figure 4C:
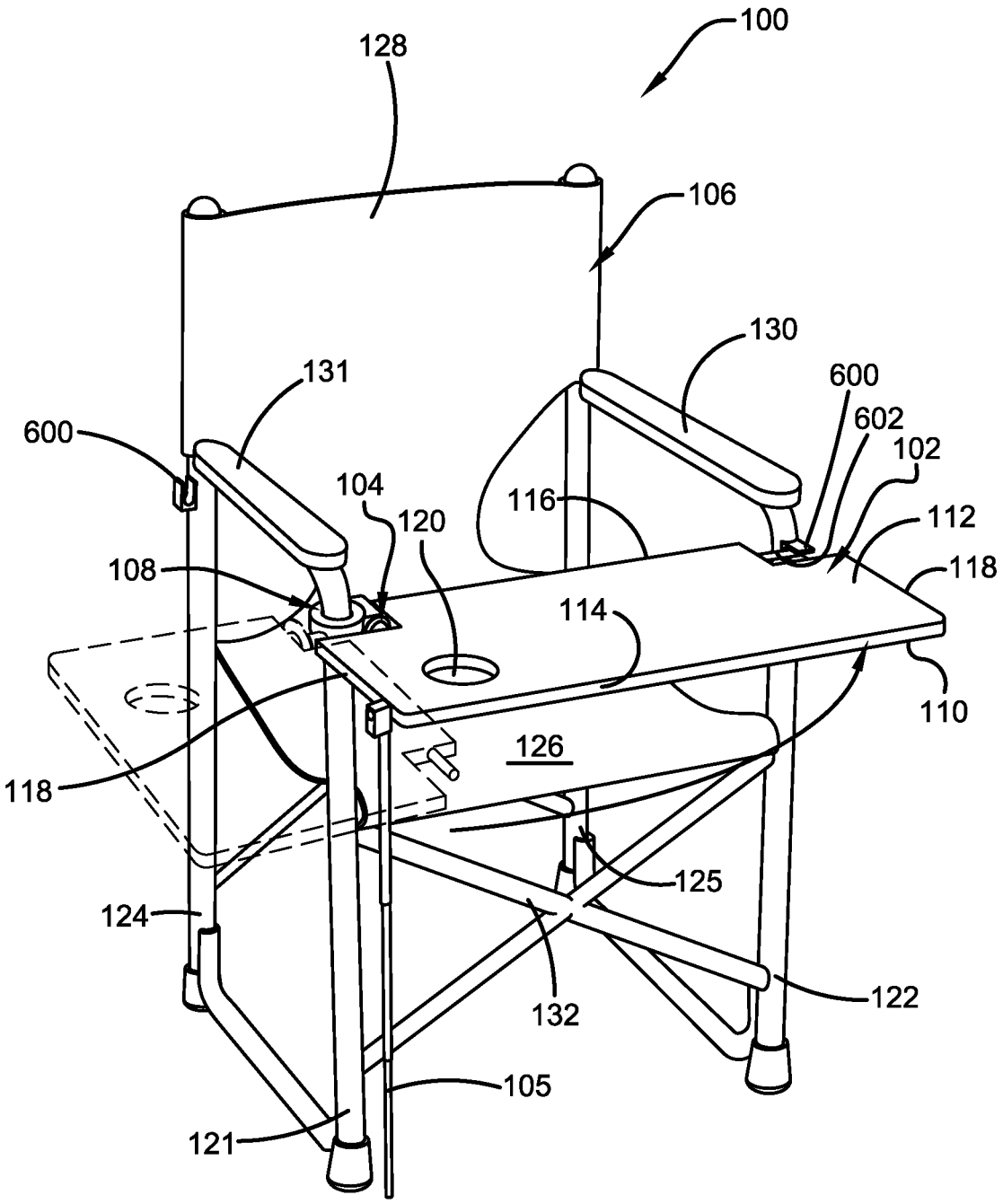

Referring initially to the drawings, FIGS. 1-3 illustrate the removable tray device 100 that offers a simple and easy way to eat or drink when sitting outside. The removable tray device 100 comprises a tray component 102 secured to a folding chair 106 via a pinned hinge 104 that allows the tray component 102 to rotate vertically (i.e., flip 180 degrees) and a swivel component 108 that allows the tray component 102 to swivel horizontally (as shown in FIGS. 4A-C).

The tray component 102 comprises a top surface 110, a bottom surface 112, a front edge 114, a back edge 116, and opposing sides 118. Typically, the tray component 102 is rectangular in shape but can be any suitable shape as is known in the art without affecting the overall concept of the invention, such as oval, circular, square, etc., as long as the tray component 102 can support food, beverages, and/or other items. The tray component 102 would generally be constructed of UV stabilized and food grade plastics, such as polyvinyl chloride (PVC), acrylonitrile butadiene styrene (ABS), polycarbonate (PC), etc., or composite polymers, though any other suitable material may be used to manufacture the tray component 102 as is known in the art without affecting the overall concept of the invention.

The tray component 102 can also comprise a variety of colors and designs to suit user and manufacturing preference. While the shape and size of the tray component 102 may vary greatly depending on the wants and needs of a user, the tray component 102 is approximately between 13 and 14 inches in depth as measured from a front edge 114 to a back edge 116, and approximately between 19 and 22 inches wide as measured from opposing sides 118, and approximately between ¾ and 1 inch thick as measured from a top surface 110 to a bottom surface 112.

Additionally, the tray component 102 is secured to a folding chair 106. The folding chair 106 can be any typical folding chair as is known in the art, or any other suitable chair, bench, etc. The folding chair 106 comprises a pair of front legs (right leg 122 and left leg 121) and a pair of back legs (right leg 125 and left leg 124), a seat 126, a back rest 128, a pair of arms (right arm 130 and left arm 131), and supports 132, and other suitable parts of a chair. The folding chair 106 typically comprises coated aluminum tubing for legs 121, 122, 124, and 125 and/or arms 130 and 131 and/or supports 132, or other suitable materials as is known in the art. The seat 126 and back rest 128 can be made from a durable, weatherproof material, such as canvas, or any other suitable material as is known in the art without affecting the overall concept of the invention.

The removable tray device 100 further comprises a pinned hinge 104 and a swivel component 108 secured to the left front leg 121 of the folding chair 106 for removably securing the tray component 102 to the front leg 121 and allowing it to move, however any other suitable mechanism can be used in place of the pinned hinge 104 or swivel component 108 as is known in the art, as long as the mechanism secures the tray component 102 to the front leg 121 and allows it to move.

The pinned hinge 104 and swivel component 108 can be secured to either front leg 121 or 122 of the folding chair 106, depending on the needs and wants of a user. The tray component 102 is then secured to whichever leg 121 and 122 of the folding chair 106 comprises the pinned hinge 104 and swivel component 108. Therefore, a right-handed user can secure the tray component 102 to the left front leg 121 of the folding chair 106 and a left-handed user can secure the tray component 102 to the right front leg 122 of the folding chair 106.

Further, the tray component 102 comprises support arms 103 (as shown in FIG. 2) and/or a support leg 105 (as shown in FIG. 4A) that is secured to the bottom 112 or sides 118 of the tray component 102 and that fold up and store under the tray component 102 when not in use. The support arms 103 and/or support leg 105 can be secured to the tray component 102 via any suitable securing means as is known in the art, such as gluing, welding, fasteners, etc. During use, the support arms 103 are folded down and secured to the legs 121, 122, 124, 125, or supports 132 of the chair 106. Specifically, the support arms 103 fit over and are secured to a raised bolt 101 or other securing device as is known in the art on the legs 121, 122, 124, 125, or supports 132 of the chair 106. The support leg 105 is typically secured to one of the sides 118 of the tray component 102 and telescopes into a compacted position during storage and then telescopes out into an extended position during use. Specifically, the support leg 105 rests on the floor when extended for use (as shown in FIG. 4A) to support the tray component 102.

Additionally, the tray device 100 comprises a pinned hinge 104 securing the tray component 102 to the left front leg 121. The pinned hinge 104 allows the tray component 102 to rotate vertically (flips 180 degrees) out in front of the folding chair 106 (as shown in FIG. 4B), or rotate downward into a storage position (as shown in FIG. 3). Then, the swivel component 108 allows the tray component 102 to swivel horizontally to a front of the folding chair 106 (as shown in FIG. 4C). The swivel component 108 is typically a swivel joint which affixes the tray component 102 to the left front leg 121 and allows the tray component 102 to swivel horizontally about the left front leg 121. However, any other suitable swivel component 108 can be used as is known in the art, as long as the swivel component 108 secures to the tray component 102 and allows it to swivel horizontally.

The pinned hinge 104 is a typical lock and release pinned hinge. The pinned hinge 104 comprises a pin 500 that secures to a snap ring 502 which secures the pin 500 within the swivel joint housing 108. The pin 500 comprises a first end 504 and a second end 506 held together by a hinge pin 508. A locking collar 510 then secures to the pin 500 and locks it (i.e., the collar 510 covers the hinge joint created by the hinge pin 508), or unlocks it (i.e., the collar 510 does not cover the hinge joint created by the hinge pin 508). A snap ring 514 holds a spring 512 onto the locking collar 510 to allow the collar 510 to move up and down to cover or uncover the hinge joint. The locking collar 510 is then secured to the tray component 102 via a bracket or other such securing mechanism. Thus, when the locking collar 510 is pushed in, it allows the tray component 102 to rotate down as the collar 510 is not covering the hinge joint, which allows the hinge to bend at the joint. When the locking collar 510 is released and the spring 512 pushes against the collar 510, the collar 510 moves over the hinge joint, restricting hinge movement and locking the tray component 102 so it cannot rotate up or down.

In a further preferred embodiment, the tray component 102 comprises a catch or lock bracket 600 on a leg 121, 122, 124, or 125 of the chair 106 which corresponds with a mating lock pin 602 secured to a back edge 116 of the tray component 102. Specifically, the lock pin 602 of the tray component 102 mates to and is secured within (i.e., always within intimate contact with) the catch or lock bracket 600 to further secure the tray component 102 to the folding chair 106 when the tray component 102 is in front of the folding chair 106 or is to the side of the folding chair 106. The chair 106 can comprise any suitable number of catch or lock brackets 600 on any one of the legs 121, 122, 124, or 125 depending on the wants and needs of a user. Furthermore, the tray component 102 comprises a cut-out or continuous opening, or a shallow indentation on the top surface 110 of the tray component 102. The continuous opening acts as a drink holder 120 for retaining a beverage or other item. The tray component 102 can comprise any suitable number of drink holders 120 depending on the wants and needs of a user.

FIGS. 4A-4B illustrate the removable tray device 100 rotating and swiveling. As stated supra, the tray device 100 comprises a pinned hinge 104 secured to the tray component 102 for allowing the tray component 102 to rotate vertically (approximately 180 degrees) out in front of the folding chair 106, or rotate down into a storage position. The tray device 100 further comprises a swivel component 108 secured to the tray component 102 for allowing the tray component 102 to swivel horizontally to the front of the folding chair 106. The swivel component 108 is typically a swivel joint which affixes the tray component 102 to the left front leg 121 and allows the tray component 102 to swivel horizontally about the left front leg 121. However, any other suitable swivel component 108 can be used as is known in the art, as long as the swivel component 108 secures to the tray component 102 and allows it to swivel horizontally.

As stated supra, the pinned hinge 104 is a typical lock and release pinned hinge. The pinned hinge 104 comprises a pin 500 secured within the swivel joint housing 108 (swivel component) via a snap ring 502. The pin 500 comprises a first end 504 and a second end 506 held together by a hinge pin 508 to create a hinge joint. A locking collar 510 then secures to the pin 500 and locks it (i.e., the collar 510 covers the hinge joint), or unlocks it (i.e., the collar 510 does not cover the hinge joint). The locking collar 510 is retained on the hinge joint via a snap ring 514 and a spring 512 which allows the collar 510 to move up and down to cover or uncover the hinge joint. The locking collar 510 is then secured to the tray component 102 via a bracket or other such securing mechanism. Accordingly, when the locking collar 510 is pushed in, the hinge is allowed to bend at the joint which allows the tray component 102 to rotate down (or vertically up) as the collar 510 is not covering the hinge joint. When the locking collar 510 is released and the spring 512 pushes against the collar 510, the collar 510 moves over the hinge joint, restricting hinge movement and locking the tray component 102 so it cannot rotate up or down.

Figure 5A:
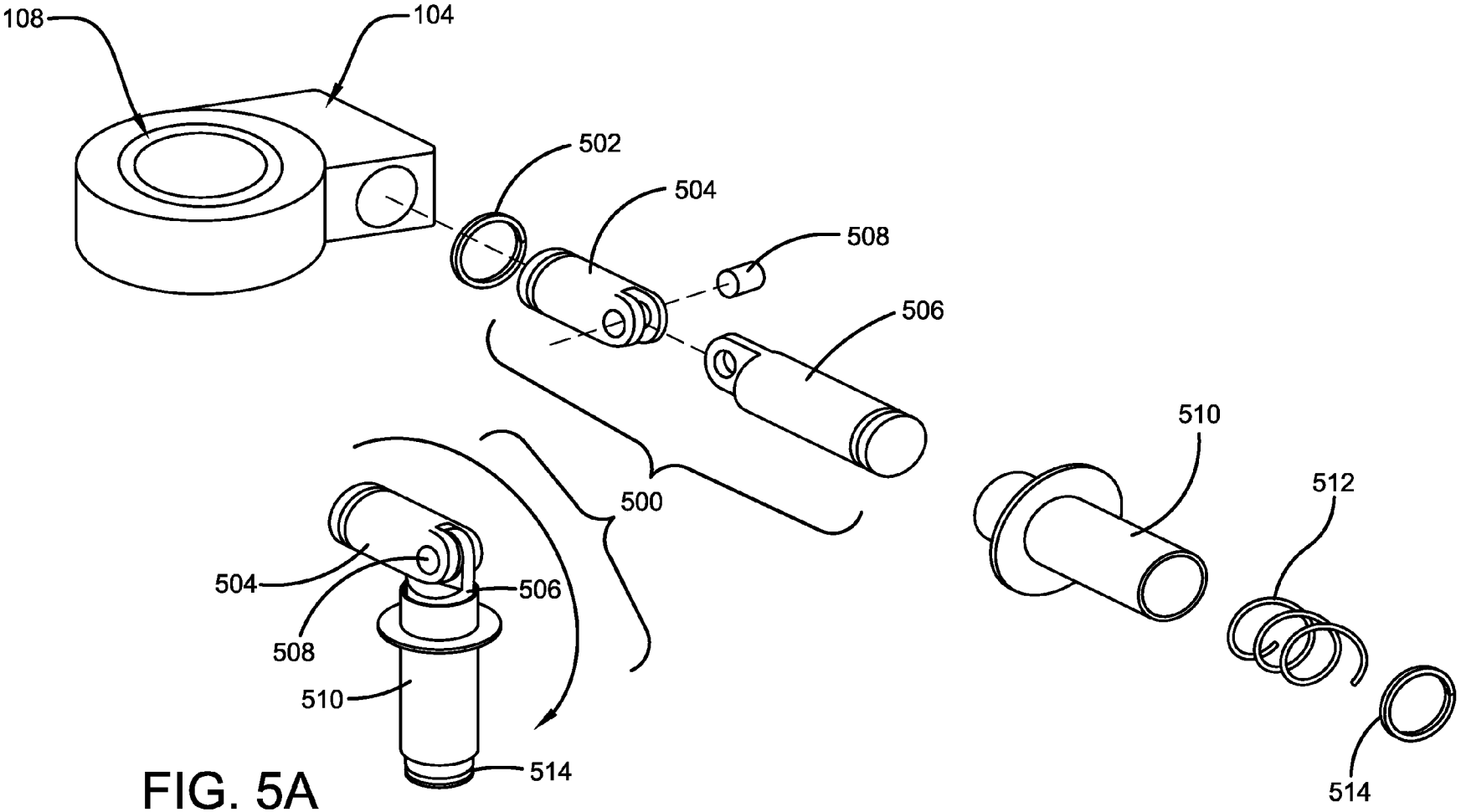
FIG. 5A illustrates an exploded view of the pinned hinge in accordance with the disclosed architecture.
Figure 5B:
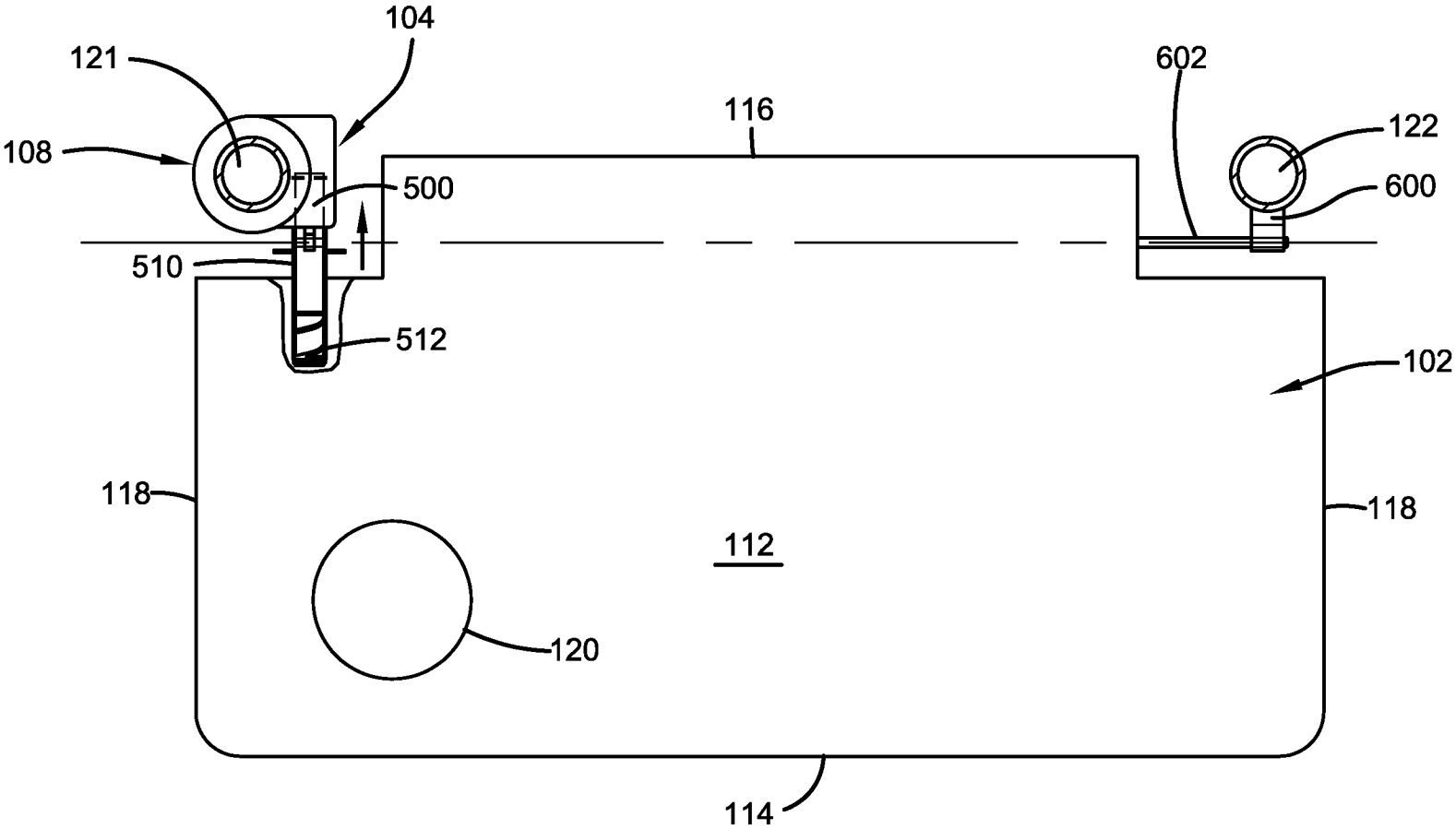
FIGS. 5B-5C illustrate a top view of the locking collar in accordance with the disclosed architecture.
Figure 5C:
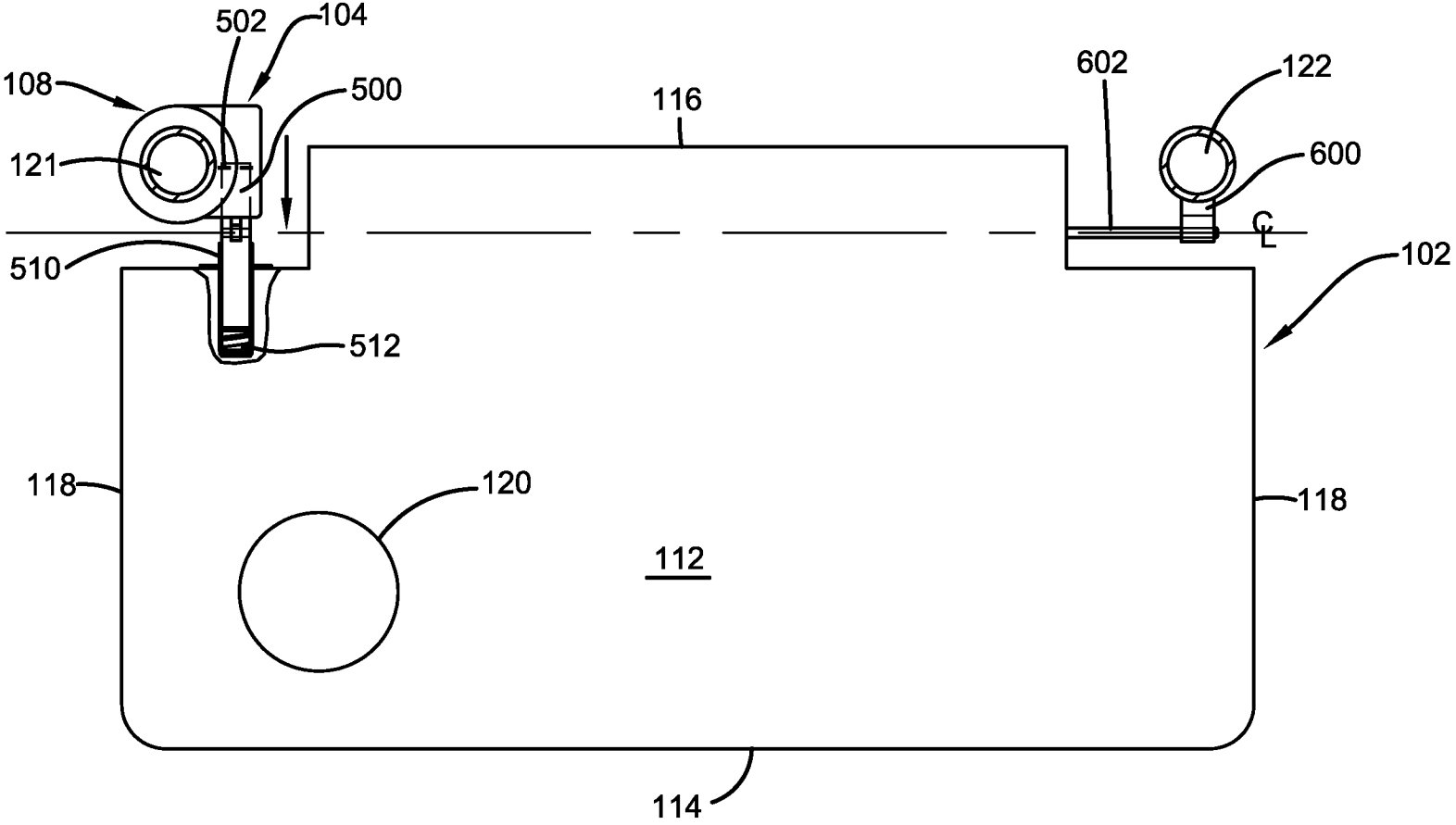
Figure 6:
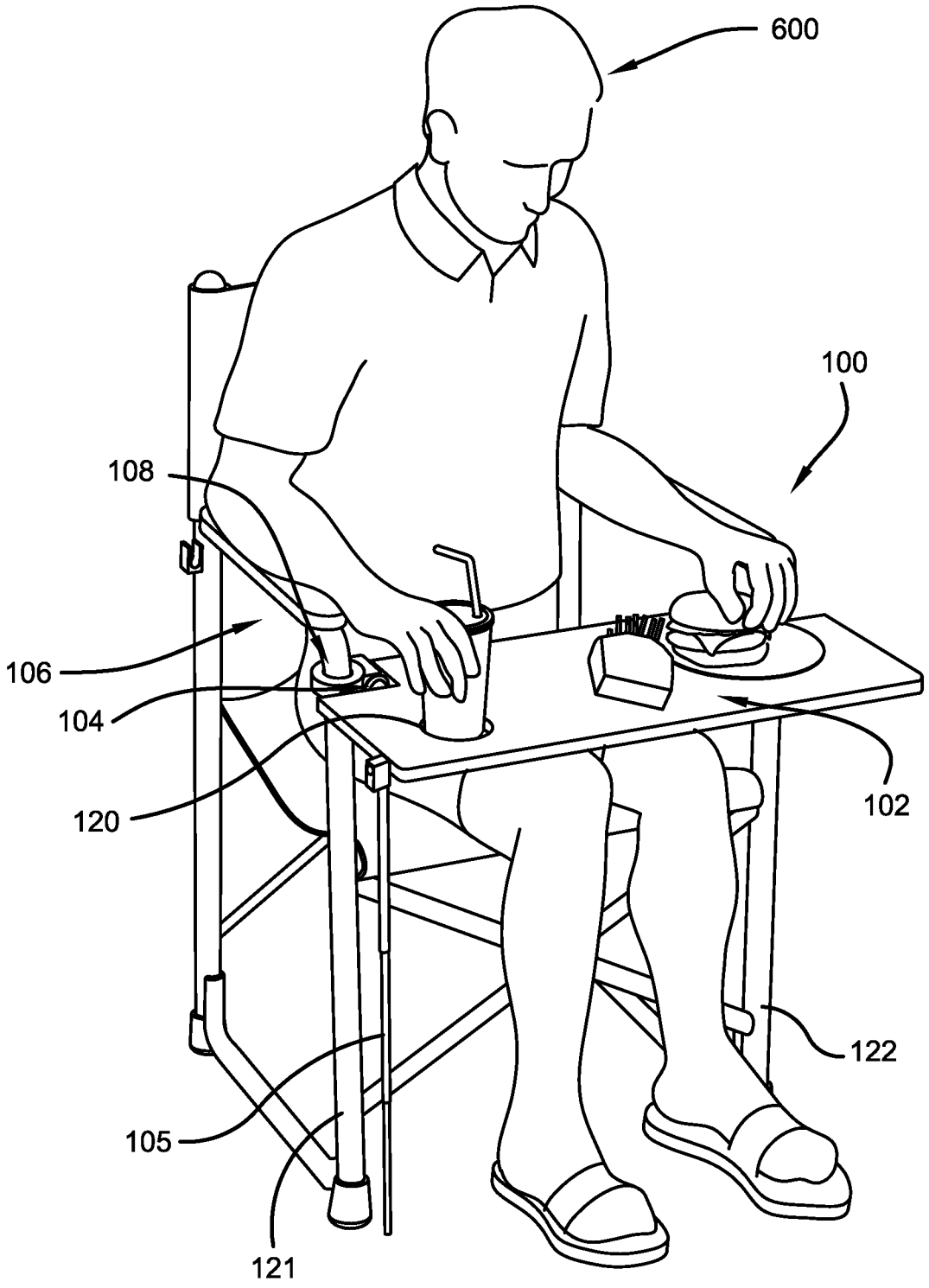
FIG. 6 illustrates a perspective view of the removable tray device in use in accordance with the disclosed architecture.

FIG. 5 illustrates the removable tray device 100 in use. As stated supra, the removable tray device 100 comprises a tray component 102 secured to a folding chair 106 via a pinned hinge 104 that allows the tray component 102 to rotate vertically (i.e., flip 180 degrees) and a swivel component 108 that allows the tray component 102 to swivel horizontally. The tray component 102 further comprises a catch or lock bracket 600 on a leg 122 and 124 of the chair 106 which corresponds with a mating lock pin 602 secured to a back edge 116 of the tray component 102. Specifically, the locking pin 602 of the tray component 102 mates to and is secured within the catch or lock bracket 600 to further secure the tray component 102 to the folding chair 106 when the tray component 102 is in front of the folding chair 106 or is to the side of the folding chair 106. Furthermore, the tray component 102 comprises a cut-out or continuous opening that acts as a drink holder.

In operation, a user 600 would choose the size and/or color of the removable tray device 100 that meets the user's needs and/or wants. The user 600 would then attach the removable tray device 100 to a predetermined folding chair 106 via attaching the tray component 102 to the pinned hinge 104 and swivel component 108 positioned on the front leg 121 of the folding chair 106. The user 600 can then sit in the folding chair 106 and can vertically rotate (approximately 180 degrees) the tray component 102 out in front of the folding chair 106, and can horizontally swivel the tray component 102 in front of the chair 106 for use. The user 600 can then telescopically extend the support leg 105 from the side 118 of the tray component 102 to rest on the floor for additional support. Once the user 600 is done using the removable tray device 100, the user 600 can collapse the support leg 105 and reverse the direction and horizontally swivel the tray component 102 back out in front of the chair 106, then vertically rotate (i.e., flip up 180 degrees) the tray component 102 beside the chair 106, and then rotate down the tray component 102 in a storage position (as shown in FIG. 3). Thus, the removable tray device 100 provides a flat tray surface for eating, drinking, or other activities when sitting outside, and rotates down against the side of the chair 106 when not in use for convenient storage.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A removable tray device for use with a chair comprising:

a tray component comprising a top surface, a bottom surface, a front edge, and a back edge; and a swivel component secured to a left front leg of the chair for removably securing the tray component to the left front leg and for swiveling horizontally relative to a plane of the tray component; and a pinned hinge secured to the swivel component for allowing the tray component to rotate vertically up for use or down into a storage position relative to a leg of the chair; and wherein the pinned hinge comprises a pin, a hinge joint, and a locking collar which acts to lock or release the pinned hinge; and wherein a snap ring holds a spring onto the locking collar to allow the collar to move up and down to cover or uncover the hinge joint; and wherein the locking collar is secured to the tray component via a bracket such that when the locking collar is pushed in, the tray component rotates up or down, and when the locking collar is released and the spring pushes against the collar, the collar moves over the hinge joint, locking the tray component in place so it cannot rotate up or down; and wherein the pinned hinge allows the tray component to rotate vertically out in front of the chair relative to the leg of the chair and the swivel component allows the tray component to swivel horizontally in front of the chair for use relative to the plane of the tray component; and a pair of support arms secured to the bottom surface of the tray component, wherein the pair of support arms fold up and store under the tray component when not in use, and are folded down and secured to legs of the chair via a raised bolt when in use.

2. The removable tray device of claim 1, wherein the tray component further comprises a catch bracket on a leg of the chair which corresponds with a mating lock pin secured to a back edge of the tray component.

3. The removable tray device of claim 2, wherein the mating lock pin of the tray component mates to and is secured within the catch bracket to further secure the tray component to the chair.

4. The removable tray device of claim 1, wherein the tray component further comprises a continuous opening for a drink holder on the top surface.

5. The removable tray device of claim 1, wherein the tray component is comprised of food grade and UV stabilized plastic.

6. The removable tray device of claim 1, wherein the tray component is comprised of a composite polymer.

7. The removable tray device of claim 1, wherein the tray component is approximately 22 inches wide and approximately 14 inches deep.

8. A removable tray device for use with a folding chair comprising:

a tray component comprising a top surface, a bottom surface, a front edge, and a back edge; and a swivel component secured to a left front leg of the chair for removably securing the tray component to the left front leg and for swiveling horizontally relative to a plane of the tray component; and a pinned hinge secured to the swivel component for allowing the tray component to rotate vertically up for use or down into a storage position relative to a leg of the chair;

wherein the pinned hinge comprises a pin, a hinge joint, and a locking collar which acts to lock or release the pinned hinge; and wherein a snap ring holds a spring onto the locking collar to allow the collar to move up and down to cover or uncover the hinge joint; and wherein the locking collar is secured to the tray component via a bracket such that when the locking collar is pushed in, the tray component rotates up or down, and when the locking collar is released and the spring pushes against the collar, the collar moves over the hinge joint, locking the tray component in place so it cannot rotate up or down; and a catch bracket on a leg of the chair which corresponds with a mating lock pin secured to a back edge of the tray component; and wherein the pinned hinge allows the tray component to rotate vertically out in front of the chair relative to the leg of the chair and the swivel component allows the tray component to swivel horizontally in front of the chair for use relative to the plane of the tray component; and a pair of support arms secured to the bottom surface of the tray component, wherein the pair of support arms fold up and store under the tray component when not in use, and are folded down and secured to legs of the chair via a raised bolt when in use.

9. The removable tray device of claim 8, wherein the tray component further comprises a continuous opening for a drink holder on the top surface.

10. The removable tray device of claim 8, wherein the tray component is comprised of food grade and UV stabilized plastic.

11. The removable tray device of claim 8, wherein the tray component is comprised of a composite polymer.

12. The removable tray device of claim 8, wherein the tray component is approximately 22 inches wide and approximately 14 inches deep.

13. A removable tray assembly comprising:

a folding chair comprising a pair of front legs and a pair of back legs, a seat, and a back rest; and a tray component comprising a top surface, a bottom surface, a front edge, and a back edge;

a swivel component secured to a left front leg of the chair for removably securing the tray component to the left front leg and for swiveling horizontally relative to a plane of the tray component;

a pinned hinge secured to the swivel component for allowing the tray component to rotate vertically up for use or down into a storage position relative to a leg of the chair;

wherein the pinned hinge comprises a pin, a hinge joint, and a locking collar which acts to lock or release the pinned hinge; and wherein a snap ring holds a spring onto the locking collar to allow the collar to move up and down to cover or uncover the hinge joint; and wherein the locking collar is secured to the tray component via a bracket such that when the locking collar is pushed in, the tray component rotates up or down, and when the locking collar is released and the spring pushes against the collar, the collar moves over the hinge joint, locking the tray component in place so it cannot rotate up or down; and a catch bracket on a leg of the chair which corresponds with a mating lock pin secured to a back edge of the tray component; and a support leg secured to a side of the tray component, wherein the support leg is telescopically extended to rest on a floor for additional support when the tray component is in use.

14. The removable tray assembly of claim 13, wherein the pinned hinge allows the tray component to rotate vertically out in front of the chair relative to the leg of the chair and the swivel component allows the tray component to swivel horizontally in front of the chair for use relative to the plane of the tray component.

15. The removable tray assembly of claim 13, wherein the tray component further comprises a continuous opening for a drink holder on the top surface.

16. The removable tray assembly of claim 13, wherein the tray component is comprised of food grade and UV stabilized plastic.

17. The removable tray assembly of claim 13, wherein the tray component is approximately 22 inches in width and approximately 14 inches in depth.

* * * * *